US011339974B2

(12) United States Patent
Chadwick et al.

(10) Patent No.: US 11,339,974 B2
(45) Date of Patent: May 24, 2022

(54) MULTIFUNCTIONAL STEAM COOKING APPLIANCE WITH ACTIVE AIR INLET

(71) Applicants: BSH Home Appliances Corporation, Irvine, CA (US); BSH Hausgeräte GmbH, Munich (DE)

(72) Inventors: Temple Chadwick, New Bern, NC (US); Amanda Pegg, New Bern, NC (US); George Savitz, New Bern, NC (US); Anjanetta Sparrow, New Bern, NC (US); Benjamin Wagner, Bretten (DE); Adrienne Whitson, New Bern, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 479 days.

(21) Appl. No.: 16/360,051

(22) Filed: Mar. 21, 2019

(65) Prior Publication Data

US 2020/0300479 A1 Sep. 24, 2020

(51) Int. Cl.

| | |
|---|---|
| ***H05B 6/64*** | (2006.01) |
| ***H05B 6/80*** | (2006.01) |
| ***F24C 15/20*** | (2006.01) |

(52) U.S. Cl.

CPC ..... *F24C 15/2007* (2013.01); *F24C 15/2021* (2013.01); *H05B 6/6441* (2013.01); *H05B 6/6479* (2013.01); *H05B 6/80* (2013.01)

(58) Field of Classification Search

CPC ..... F24C 15/2007; F24C 15/2021; F24C 15/327; H05B 6/6441; H05B 6/6479; H05B 6/80

(Continued)

(56) References Cited

U.S. PATENT DOCUMENTS

| | | | |
|---|---|---|---|
| 4,839,502 | A | 6/1989 | Swanson et al. |
| 5,515,773 | A | 5/1996 | Bullard |

(Continued)

FOREIGN PATENT DOCUMENTS

| | | | |
|---|---|---|---|
| EP | 0279065 | A2 | 8/1988 |
| EP | 0319673 | A1 | 6/1989 |
| EP | 0926448 | A2 | 6/1999 |

OTHER PUBLICATIONS

EP 0319673A1 Translation, Device and method for controlling the steam in a steam-proofing apparatus, Sep. 18, 1991, ProQuest (Year: 1991).*

(Continued)

*Primary Examiner* — Quang T Van

(74) *Attorney, Agent, or Firm* — Michael E. Tschupp; Andre Pallapies; Brandon G. Braun

(57) ABSTRACT

A cooking appliance that uses steam to heat a food item includes a cooking chamber; a steam generator that generates steam to heat the food item; a heating element that generates heat to heat the food item; an outlet that fluidly connects the cooking chamber to a first external environment outside of the cooking chamber; and an active inlet that fluidly connects the cooking chamber to a second external environment outside of the cooking chamber. The active inlet has a blocking member that prevents a fluid from the second external environment from entering the cooking chamber though the active inlet, and an actuator that moves the blocking member between a closed position in which the blocking member prevents the fluid from entering the cooking chamber through the active inlet, and an open position in which the blocking member allows the fluid to enter the cooking chamber through the active inlet.

18 Claims, 4 Drawing Sheets

(58) Field of Classification Search
USPC ..... 219/680, 681, 682, 401, 413, 494, 496, 219/620, 685, 686, 735, 741, 757, 761; 426/231, 243, 113; 99/330, 331, 342, 99/468, 476, 327; 126/21 A, 369
See application file for complete search history.

(56) References Cited

U.S. PATENT DOCUMENTS

| | | | | |
|---|---|---|---|---|
| 6,070,517 | A | 6/2000 | Helm | |
| 6,860,261 | B2 | 3/2005 | Hines, Jr. | |
| 6,878,910 | B2 | 4/2005 | Kim et al. | |
| 7,946,220 | B2 * | 5/2011 | Ose | F24C 15/327 99/327 |
| 2004/0261623 | A1 | 12/2004 | Bartelick | |
| 2004/0261632 | A1 * | 12/2004 | Hansen | A21B 3/04 99/468 |
| 2014/0291312 | A1 * | 10/2014 | Wurdinger | A21B 3/04 219/401 |
| 2016/0077678 | A1 | 3/2016 | Reese et al. | |

OTHER PUBLICATIONS

National Serch Report EP 20 16 2425 dated Jun. 30, 2020.

* cited by examiner

MULTIFUNCTIONAL STEAM COOKING APPLIANCE WITH ACTIVE AIR INLET

FIELD OF THE INVENTION

The invention is directed to an apparatus and method related to venting steam cooking appliances. More particularly, embodiments of the invention are directed to including an active air inlet in multifunctional cooking appliances that use steam to cook food.

An example of an application for the invention is a domestic kitchen multifunctional steam oven having an active air inlet for pressure and/or humidity regulation.

BACKGROUND OF THE INVENTION

Some modern domestic kitchens include various kinds of ovens such as, for example, conventional ovens, microwave ovens, convection ovens, and steam ovens. With steam ovens increasing in popularity in recent years, and with limited space in many kitchens, combination ovens that are multifunctional are very useful. A multifunctional steam oven and conventional oven (or steam oven and some other type of oven) can provide versatility in a compact space.

Applicants recognized a problem that can exist with some multifunctional steam ovens in that proper venting of the oven cavity after a steam mode can be difficult and/or time consuming. Applicants also recognized that proper venting can greatly increase cooking performance.

Applicants solved this problem with embodiments of the invention.

SUMMARY

The invention achieves the benefit of providing a combination steam oven while also addressing the venting problem mentioned above. Embodiments of the invention provide an active inlet that is controlled such that it is closed during a steam mode and open during a conventional cooking mode.

Embodiments of the invention are based on the inventors' recognition that an active inlet that can be closed and opened depending on the cooking mode provides great benefits with regard to humidity control.

Particular embodiments of the invention are directed to a domestic home cooking appliance that uses steam to heat a food item. The appliance includes a cooking chamber configured to receive the food item; a steam generator configured to generate the steam to heat the food item; a heating element configured to generate heat to heat the food item; an exhaust outlet that fluidly connects the cooking chamber to a first external environment outside of the cooking chamber; and an active inlet that fluidly connects the cooking chamber to a second external environment outside of the cooking chamber. The active inlet has a blocking member that prevents a fluid from the second external environment from entering the cooking chamber though the active inlet, and an actuator that moves the blocking member between a closed position in which the blocking member prevents the fluid from entering the cooking chamber through the active inlet, and an open position in which the blocking member allows the fluid to enter the cooking chamber through the active inlet.

In some embodiments the controller includes programming that controls the steam generator to generate steam to heat the food item during a first heating mode, the generated steam being the only source of heat that heats the food item during the first heating mode, and the controller includes programming that controls the heating element to generate heat to heat the food item during a second heating mode, the generated heat being the only source of heat that heats the food item during the second heating mode.

Other embodiments of the invention are directed to a method of controlling humidity in a domestic home cooking appliance. The method includes providing a cooking chamber that receives the food item; providing a steam generator that generates the steam to heat the food item; providing a heating element that generates heat to heat the food item; providing an exhaust outlet that fluidly connects the cooking chamber to a first external environment outside of the cooking chamber; providing an active inlet that fluidly connects the cooking chamber to a second external environment outside of the cooking chamber, the active inlet having a blocking member and an actuator that moves the blocking member between an open position and a closed position; preventing a fluid from the second external environment from entering the cooking chamber through the active inlet by moving the blocking member to the closed position; and allowing the fluid to enter the cooking chamber through the active inlet by moving the blocking member to the open position.

Some embodiments further include generating steam with the steam generator to heat the food item during a first heating mode, the generated steam being the only source of heat that heats the food item during the first heating mode, and generating heat with the heating element to heat the food item during a second heating mode, the generated heat being the only source of heat that heats the food item during the second heating mode.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, embodiments of the invention provide a solution to the problems associated with multifunctional steam ovens that have a steam mode and another cooking mode, such as, for example, a conventional heating mode, a convection heating mode, or a microwave mode.

Figure 1:
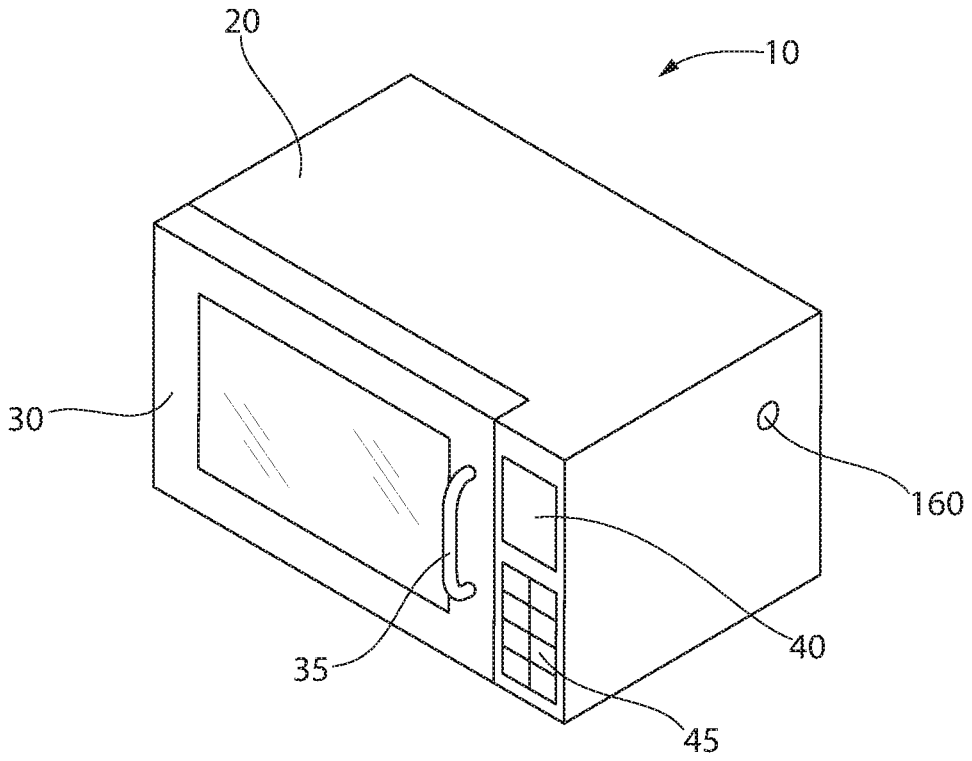
FIG. 1 is a perspective view of an exemplary appliance in accordance with embodiments of the invention.
Figure 2:
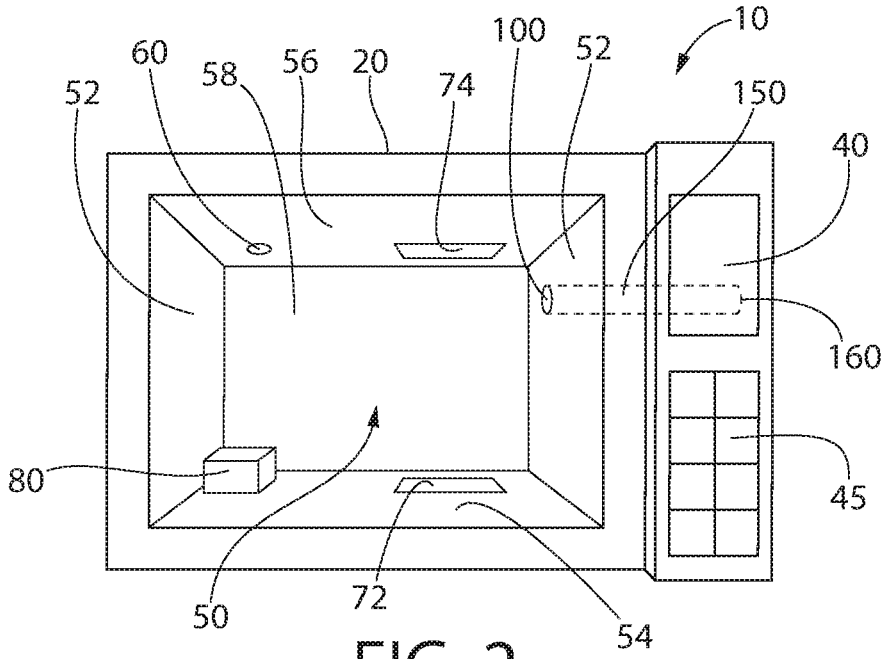
FIG. 2 is a front view of the exemplary appliance shown in FIG. 1 with the door removed for clarity.

FIG. 1 shows an example of a multifunctional oven 10 that can operate as a steam oven and a conventional oven. Oven 10 has a main body 20 and a door 30 that provides access to a cooking chamber 50 (FIG. 2). Door 30 has, in this example, a handle 35 by which a user can open door 30. In this example, oven 10 has a control panel 45 that includes user operable controls for, among other things, mode selection, cooking duration, cooking temperature, and power level. A display 40 is provided to supply information to the user such as, for example, mode, temperature, time remaining, and other information. Display 40 can also include touchscreen or other types of controls. Also shown in FIG. 1 is an inlet hole 160 that provides access to air outside of oven 10.

FIG. 2 shows oven 10 with door 30 removed for clarity. Inlet hole 160 is fluidly connected to an active inlet 100 by a tube or other conduit 150. Although not shown in FIG. 2, conduit 150 can include a fan or other air mover to induce air flow from outside oven 10, into inlet hole 160, through conduit 150, out of active inlet 100, and into cooking chamber 50. The function and purpose of active inlet 100 will be described in more detail below. In this example, cooking chamber 50 has two side walls 52, a bottom surface 54, a top surface 56, and a back wall 58. Cooking chamber 50 has a vent 60 located, in this example, in top surface 56. Vent 60 can be an exhaust vent or a two directional vent that also allows air from outside cooking chamber 50 to enter or exit cooking chamber 50. Vent 60 can be attached to a conduit (not shown) to connect vent 60 to a space inside main body 20 and/or to the environment outside of main body 20. Similarly, active inlet 100 can be connected to a space inside main body 20 and/or to the environment outside of main body 20 by conduit 150 or some other conduit.

Multifunction ovens in accordance with embodiments of the invention have a steam generator and some other type of cooking apparatus such as, for example, a conventional heating element, a convection system, a microwave system, an induction heating system, or some other type of cooking system. In the example shown in FIG. 2, multifunctional oven 10 has a steam generator 80 and two conventional heating elements 72, 74. Steam generator 80 and conventional heating elements 72, 74 are shown schematically and the exemplary locations and number are not limiting. The term "heating element" as used in this specification and claims is understood to include any type of non-steam generating heating or cooking device including, but not limited to, a conventional heating element, a convection system, a microwave system, and/or an induction heating system.

Embodiments of the invention include a steam oven which operates in what is referred to as "full steam" mode, which is understood to mean 100% relative humidity with little or no over pressure (pressure inside the cooking chamber that is above atmospheric pressure outside of the cooking chamber. Steam oven in accordance with embodiments of the invention also operate in steam assist or partial steam modes where steam is added to normal cooking modes (those that do not include steam). Cooking chambers that operate in full steam mode are sealed to prevent electrical and other components from damage resulting from exposure to moisture. These ovens can be multifunctional ovens which also have normal heating modes like, for example, bake and convection. As a result of this sealed cavity it can be difficult to develop normal heating modes (those that do not include steam). It can be difficult to properly vent the moisture that needs to be removed from the cooking chamber, even if an active exhaust vent is provided. The term "active" when used with an exhaust, inlet, or other vent is understood to mean an opening that can be closed or opened. The closing or opening can be achieved automatically or manually by a user, a spring or other mechanism, or a control system of the oven. For example, an active exhaust or inlet can be opened or closed by an electric actuator that is controlled by an electronic controller in the oven as a result of the current operational mode.

Some embodiments of the invention contain an active inlet in the appliance which opens and closes actively or even automatically, depending on the pressure inside the cooking chamber. A purpose of the active inlet is to reduce the humidity during normal heating modes by introducing fresh air into the cooking chamber. An exhaust outlet can be, for example, connected to the under-pressure side of a convection fan and can create constant under pressure. The under-pressure can cause outside air to be drawn into the cooking chamber through the open active inlet and out of the exhaust vent, thereby reducing the humidity level in the cooking chamber.

A further advantage of an active inlet is that the moisture can be removed at a specific point of time if, for example, a user wants a crust on a baking good at the end of an automatic program or heating mode. Another advantage of an active inlet is that it facilitates drying the cooking chamber with heat by allowing necessary fresh air into cooking chamber. By having an active inlet, embodiments of the invention provide flexibility to multifunctional steam ovens that is not present in multifunctional steam ovens without an active inlet. The active inlet in conjunction with an exhaust vent (either active or not) provides control over the humidity level in the cooking chamber of a multifunctional steam oven that is not currently known in the art.

Figure 3:
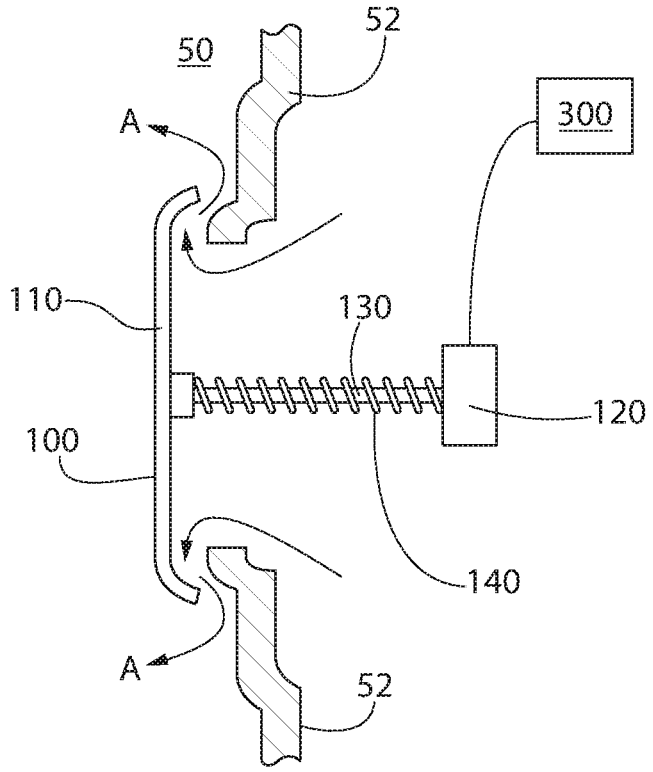
FIG. 3 is a partial sectional view of an example of an embodiment of the invention in an open position.
Figure 4:
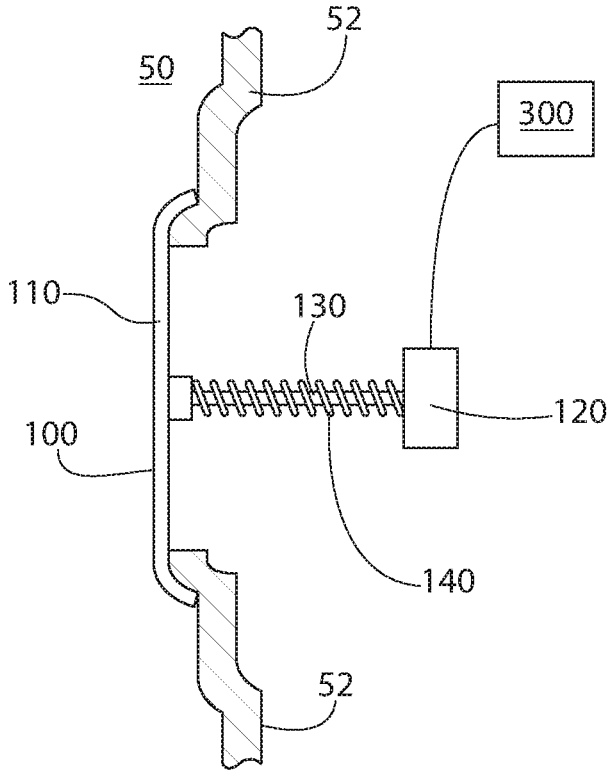
FIG. 4 is a partial sectional view of an example of an embodiment of the invention in a closed position.

FIGS. 3 and 4 show an example of an active inlet 100 in accordance with embodiments of the invention. Active inlet 100 has a blocking member 110 that can be moved between a closed position where it blocks an opening in a wall (for example, side wall 52) of cooking chamber 50 and an open position where it allows air or some other fluid to pass through the opening. FIG. 3 shows active inlet 100 in an open position where blocking member 110 is separated from side wall 52 so that air A can pass through side wall 52 and into cooking chamber 50. In this example, an actuator 120 moves a shaft 130 to move blocking member 110 left and right in the figure between the open and closed positions. A spring 140 is provided to maintain blocking member 110 in a default position (either opened or closed) when actuator 120 is not activated. In some embodiments, the default position is the closed position to prevent outside air from entering cooking chamber 50 during, for example, steam mode. In other embodiments, the default position is the open position to provide access to outside air through active inlet 100. FIG. 4 shows active inlet 100 in the closed position. In this position, blocking member 110 is in contact with side wall 52 of cooking chamber 50 to close active inlet 100. In this example, actuator 120 is controlled by a controller 300. In some embodiments, controller 300 is an electronic controller that provides instructions to actuator 120 depending on the desired mode of oven 10.

Figure 5:
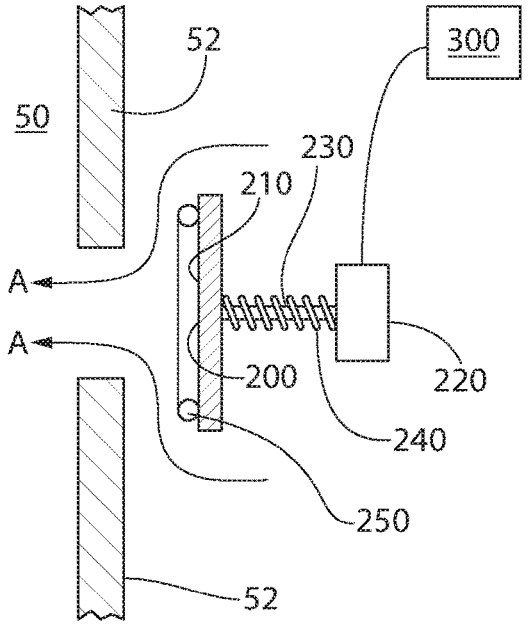
FIG. 5 is a partial sectional view of an example of an embodiment of the invention in an open position.
Figure 6:
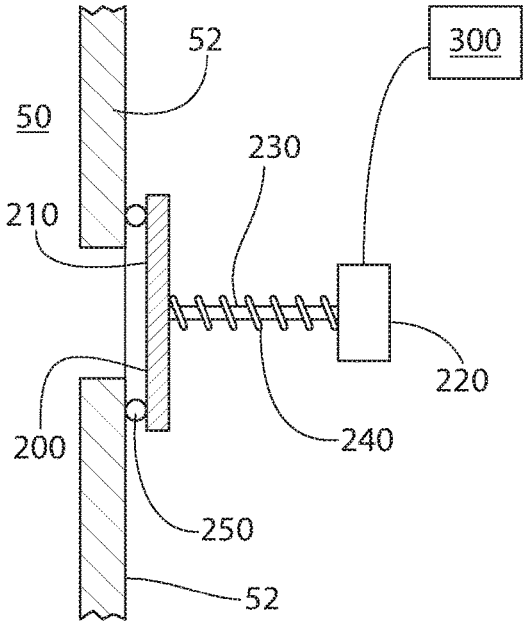
FIG. 6 is a partial sectional view of an example of an embodiment of the invention in a closed position.

While the example of active inlet 100 shown in FIGS. 3 and 4 opens inwardly into cooking chamber 50, FIGS. 5 and 6 show an example of an active inlet 200 that opens outwardly away from cooking chamber 50.

Active inlet 200 shown in FIGS. 5 and 6 has a blocking member 210 that can be moved between a closed position where it blocks an opening in a wall (for example, side wall 52) of cooking chamber 50 and an open position where it allows air or some other fluid to pass through the opening. FIG. 5 shows active inlet 200 in an open position where blocking member 210 is separated from side wall 52 so that air A can pass through side wall 52 and into cooking chamber 50. In this example, an actuator 220 moves a shaft 230 to move blocking member 210 left and right in the figure between the open and closed positions. A spring 240 is provided to maintain blocking member 210 in a default position (either opened or closed) when actuator 220 is not activated. In some embodiments, the default position is the closed position to prevent outside air from entering cooking chamber 50 during, for example, steam mode. In other embodiments, the default position is the open position to provide access to outside air through active inlet 200. FIG. 6 shows active inlet 200 in the closed position. In this position, a seal 250 mounted to blocking member 210 is in contact with side wall 52 of cooking chamber 50 to close active inlet 200. In this example, actuator 220 is controlled by controller 300. In some embodiments, controller 300 is an electronic controller that provides instructions to actuator 220 depending on the desired mode of oven 10.

While the example shown in FIGS. 3 and 4 does not include a seal and the example shown in FIGS. 5 and 6 includes a seal, it is noted that either configuration can be provided with or without a seal.

Figure 7:
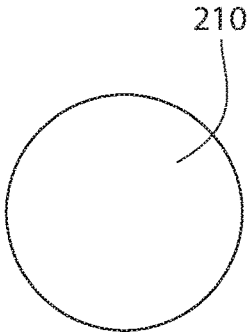
FIG. 7 is a front view of a valve plate in accordance with embodiments of the invention.
Figure 8:
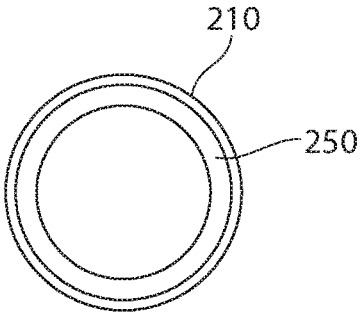
FIG. 8 is a rear view of the valve plate of FIG. 7.

FIG. 7 shows a front view (from the right in FIGS. 5 and 6) of blocking member 7. FIG. 8 shows a rear view (from the left in FIGS. 5 and 6 of blocking member 210 and seal 250.

Figure 9:
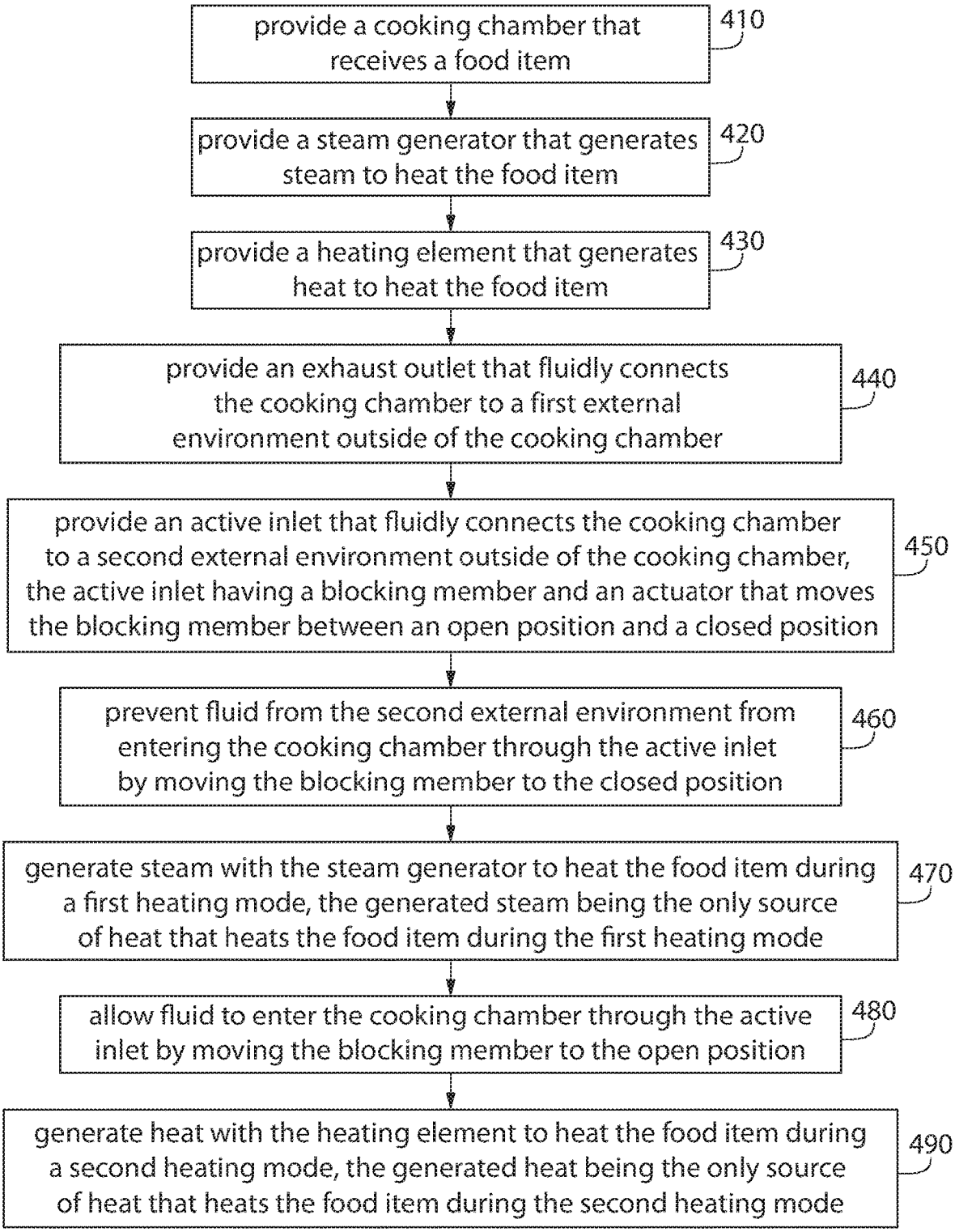
FIG. 9 shows an exemplary method in accordance with embodiments of the invention.

FIG. 9 shows an example of a method in accordance with embodiments of the invention. In FIG. 9, step 410 provides a cooking chamber that receives a food item. Step 420 provides a steam generator that generates steam to heat the food item. Step 430 provides a heating element that generates heat to heat the food item. It is noted, as explained above, that the term "heating element" includes any type of non-steam generating heating or cooking device including, but not limited to, a conventional heating element, a convection system, a microwave system, and/or an induction heating system. Step 440 provides an exhaust outlet that fluidly connects the cooking chamber to a first external environment outside of the cooking chamber. Step 450 provides an active inlet that fluidly connects the cooking chamber to a second external environment outside of the cooking chamber, the active inlet having a blocking member and an actuator that moves the blocking member between an open position and a closed position. Step 460 prevents a fluid from the second external environment from entering the cooking chamber through the active inlet by moving the blocking member to the closed position. Step 470 generates steam with the steam generator to heat the food item during a first heating mode, the generated steam being the only source of heat that heats the food item during the first heating mode. Step 480 allows the fluid to enter the cooking chamber through the active inlet by moving the blocking member to the open position. Step 490 generates heat with the heating element to heat the food item during a second heating mode, the generated heat being the only source of heat that heats the food item during the second heating mode.

FIG. 9 is just one example of a method in accordance with embodiments of the invention. Other methods are also within the scope of the invention.

It will be appreciated that variants of the above-disclosed and other features and functions, or alternatives thereof, may be combined into many other different systems or applications. Any of the features described above can be combined with any other feature described above as long as the combined features are not mutually exclusive. Various presently unforeseen or unanticipated alternatives, modifications, variations or improvements therein may be subsequently made by those skilled in the art which are also intended to be encompassed by the invention.

What is claimed is:

1. A domestic home cooking appliance that uses steam to heat a food item, the appliance comprising:

a cooking chamber configured to receive the food item;

a steam generator configured to generate the steam to heat the food item;

a heating element configured to generate heat without steam to heat the food item;

a non-active exhaust outlet that fluidly connects the cooking chamber to a first external environment outside of the cooking chamber, the exhaust outlet having only an open position; and an active inlet that fluidly connects the cooking chamber to a second external environment outside of the cooking chamber, the active inlet having a blocking member that prevents a fluid from the second external environment from entering the cooking chamber though the active inlet, and an actuator physically attached to the blocking member and that moves the blocking member, through the physical attachment to the blocking member, between a closed position in which the blocking member prevents the fluid from entering the cooking chamber through the active inlet, and an open position in which the blocking member allows the fluid to enter the cooking chamber through the active inlet;

a controller that sends instructions to the actuator to move the actuator such that the actuator moves the blocking member between the closed position and the open position, wherein the controller sends the instructions to the actuator depending on a mode of the cooking appliance.

2. The appliance of claim 1, wherein the instructions to the actuator move the actuator to the closed position during a steam mode.

3. The appliance of claim 1, wherein the controller includes programming that commands the actuator to open the active inlet to allow the fluid to flow from the second external environment to the cooking chamber.

4. The appliance of claim 3, wherein the controller includes programming that controls the steam generator to generate steam to heat the food item during a first heating mode, the generated steam being the only source of heat that heats the food item during the first heating mode, and the controller includes programming that controls the heating element to generate heat to heat the food item during a second heating mode, the generated heat being the only source of heat that heats the food item during the second heating mode.

5. The appliance of claim 4, wherein the blocking member is in the closed position during the first heating mode.

6. The appliance of claim 5, wherein the blocking member is in the open position during the second heating mode.

7. The appliance of claim 6, wherein the exhaust outlet is movable between an open position and a closed position.

8. The appliance of claim 7, wherein the controller includes programming that controls movement of the exhaust outlet between the open position and the closed position.

9. A method of controlling humidity in a domestic home cooking appliance, the method comprising:

providing a cooking chamber that receives the food item;

providing a steam generator that generates the steam to heat the food item;

providing a heating element that generates heat to heat the food item;

providing a non-active exhaust outlet that fluidly connects the cooking chamber to a first external environment outside of the cooking chamber, the exhaust outlet having only an open position;

providing an active inlet that fluidly connects the cooking chamber to a second external environment outside of the cooking chamber, the active inlet having a blocking member and an actuator, the actuator being physically attached to the blocking member and moving, through the physical attachment to the blocking member, the blocking member between an open position and a closed position;

sending instructions from a controller to the actuator to move the actuator between the closed position and the open position;

preventing a fluid from the second external environment from entering the cooking chamber through the active inlet by moving the blocking member to the closed position; and allowing the fluid to enter the cooking chamber through the active inlet by moving the blocking member to the open position, wherein the instructions sent to the actuator by the controller depend on a mode of the cooking appliance.

10. The method of claim 9, wherein the instructions to the actuator move the actuator to the closed position during a steam mode.

11. The method of claim 10, wherein the exhaust outlet balances a pressure inside the cooking chamber with a pressure outside of the cooking chamber.

12. The method of claim 9, wherein the controller includes programming that commands the actuator to open the active inlet to allow the fluid to flow from the second external environment to the cooking chamber.

13. The method of claim 12, further comprising generating steam with the steam generator to heat the food item during a first heating mode, the generated steam being the only source of heat that heats the food item during the first heating mode, and generating heat with the heating element to heat the food item during a second heating mode, the generated heat being the only source of heat that heats the food item during the second heating mode.

14. The method of claim 13, wherein the blocking member is in the closed position during the first heating mode.

15. The method of claim 14, wherein the blocking member is in the open position during the second heating mode.

16. The method of claim 13, wherein the exhaust outlet balances a pressure inside the cooking chamber with a pressure outside of the cooking chamber.

17. The method of claim 12, wherein the exhaust outlet balances a pressure inside the cooking chamber with a pressure outside of the cooking chamber.

18. The method of claim 9, wherein the exhaust outlet balances a pressure inside the cooking chamber with a pressure outside of the cooking chamber.

* * * * *